United States Patent [19]

Deproux

[11] 3,971,311

[45] July 27, 1976

[54] STRIKING DEVICE FOR DOT PRINTER

[75] Inventor: Jacques Roland Deproux, Sevres, France

[73] Assignee: Compagnie Honeywell Bull (Societe Anonyme), Paris, France

[22] Filed: Feb. 15, 1974

[21] Appl. No.: 442,834

[30] Foreign Application Priority Data

Feb. 19, 1973 France ..... 73.05754

[52] U.S. Cl. ..... 101/93.04; 101/93.28; 197/1 R

[51] Int. Cl.[2] ..... B41J 1/28

[58] Field of Search ..... 197/1 R; 101/1, 930; 335/147, 223–225, 148, 149, 282

[56] References Cited

UNITED STATES PATENTS

| | | | |
|---|---|---|---|
| 3,036,248 | 5/1962 | Nellist | 335/223 X |
| 3,039,055 | 6/1962 | Postal et al. | 335/223 X |
| 3,279,362 | 10/1966 | Helms | 101/109 X |
| 3,386,551 | 6/1968 | D'Onofrio | 197/1 R |
| 3,804,008 | 4/1974 | Hoyer | 197/49 X |

*Primary Examiner*—Clyde I. Coughenour
*Assistant Examiner*—R. T. Rader
*Attorney, Agent, or Firm*—Diller, Brown, Ramik & Wight

[57] ABSTRACT

Striking device for a dot printer, comprising an electrodynamic coil connected with a striking hammer, subjected to the action of at least one magnetic field substantially perpendicular to its plane and connected to a fixed support by means of a deformable elastic suspension unit. The device is characterized in that the electrodynamic coil is formed by at least one spiral cut in a thin metal foil and in that the elastic suspension unit is formed by narrow metal strips which are coplanar with each other and with the spiral.

17 Claims, 10 Drawing Figures

STRIKING DEVICE FOR DOT PRINTER

The present invention concerns a striking device for a dot printer, i.e. a machine in which each symbol or character is formed by the consecutive strikings of a plurality of dots whose arrangement "draws" said symbol or character.

BACKGROUND OF THE INVENTION

Striking systems of the type including a plurality of striking devices arranged side by side are well known. Each such striking device is formed by a flat electromagnetic coil integral with a striking hammer, arranged in a case and subjected to the action of magnetic fields perpendicular to the plane of said coil, the case being mounted on a support by means of a deformable elastic suspension unit. Thus, when a current is caused to circulate in one of said coils, the latter is subjected to the action of an electromagnetic force which displaces the corresponding device in the direction of the paper with the purpose of effecting a striking operation, this displacement entailing the elastic deformation of the suspension unit. Upon disappearance of this current, the electromagnetic force ceases and the striking device is restored to its initial position owing to the restoring energy that is communicated to it at the instant of its impact on the striking anvil.

Such a striking system is efficacious, but because of the large size of each of its devices, it can be used only for striking symbols or characters all at once and not for forming them in the form of a plurality of separately formed dots.

Striking devices designed for dot printers are also known in the art. These devices comprise a plurality of pins activated by a complex system of rods. Their operation and maintenance are delicate and complicated and their implementation is far from satisfactory.

SUMMARY OF THE INVENTION

The present invention remedies these disadvantages. It concerns a striking device for a dot printer offering the advantages of the character striking device mentioned above.

According to the invention, the striking device for a dot printer, comprising an electrodynamic coil integral with a striking hammer subjected to the action of at least one magnetic field practically perpendicular to its plane and connected to a fixed support by means of a deformable elastic suspension unit, is remarkable in that the electrodynamic coil is formed by at least one spiral cut in a thin metal foil sheet and in that the elastic suspension unit is formed by narrow metal strips which are coplanar with each other and with the sprial.

Thus, the striking device can be very thin and makes it possible to form a dot striking system by juxtaposing a plurality of similar devices.

Preferably, the spiral and the suspension unit are formed by chemical engraving or by cutting (for example by laser, ultrasonic means, abrasive blowpipe, etc.) of thin metal foils whose thickness is several hundredths to several tenths of a millimeter. The spiral and the suspension unt can be in one piece and obtained by cutting of the same metal foil. However, given that it is the electrical properties of the metal that are especially important for the spiral whereas it is the mechanical properties that are especially important for the suspension unit, it is preferable that the spiral and the suspension unit be cut in different metal foils and then assembled, for example by gluing or soldering.

The metal of the spiral can be copper, while that of the suspension unit can be beryllium bronze.

Advantageously, the suspension unit has the form of a spoked wheel whose central hub is fixed on a fixed axle fixed relative to the support, this wheel being inside the spiral. Thus, the striking device according to the invention pivots about this fixed axle in opposition to the elastic deformation of the wheel's spokes.

In order to provide these spokes with higher mechanical strength, it is advantageous that they not be made directly integral with the wheel, but rather that they be made integral with a thin ring which is concentric with the wheel and is connected to the wheel by short radial arms displaced angularly with respect to the spokes. Thus, each portion of the ring disposed between two of the arms can be deformed and partly absorb the forces exerted on the wheel or wheels integral with that portion of the ring.

Since the spiral or spirals of a striking device according to the invention pivot about the axle of the spoked wheel, it is indispensable that the connection unit for transmission of a supply current to a spiral can itself follow the spiral's motion. For that purpose, each connection unit comprises a plurality of coplanar narrow metal strips, converging practically toward the center of the suspension unit, these narrow strips being integral on one side with an edge of the spiral and on the other with a fixed connection zone to which is connected the generator for supplying current to the spirals. Thus, the elastic deformation of the narrow metal strips of the connection unit not only make it possible to follow the pivoting movement of the spiral, but also assist in restoring it to its initial position when its excitation disappears.

For reasons identical to those indicated above in regard to the suspension unit, although the connection unit and the spiral can be in one piece, it is preferable, on the one hand, that the connection unit be formed in a metal foil different from that forming the spiral and be assembled subsequently with the spiral, and, on the other hand, that at least on the side of the connection zone, the narrow strips be connected to the spiral by portions of the thin ring, concentric with the axle of the suspension unit, and connected to the connection zone by short arms. As before, these arms can be radial for the suspension wheel and can be displaced angularly with respect to the narrow strips. However, in order to accentuate the elastic force restoring the spiral into its initial position, the arms preferably are practically tangential with respect to the ring so as to be subjected to a traction when the spiral pivots to make a strike.

In a variant embodiment, each connection unit can be formed of a plurality of coplanar narrow metal strips converging practically toward the center of the suspension unit, these narrow strips being integral on one side with an edge of the spiral, while on the side of the connection zone they are bent and form a short oblique part subjected to a traction when the spiral pivots to make a strike.

On the side of the spiral, the narrow strips of the connection unit can be integral with a junction zone which will be soldered, glued or otherwise assembled by coupling and gluing to the sprial.

Preferably, the spiral or spirals of a striking device are pressed between nonmagnetic lateral side-plates that provide it with rigidity. Possibly, when the striking devices are joined in groups of several devices juxtaposed side by side and subjected to the action of the same magnetic units, as will be described hereinafter, the side-plates are coated externally with a layer of self-lubricating material to permit free pivoting of one device of a group with respect to its neighbors.

According to one embodiment of the invention, the striking device includes at least two spirals applied one against the other through the agency of an insulating layer and connected electrically in series so that their electromagnetic forces are added, the excitation current for the device being supplied through one of the spirals and removed through the other.

According to another embodiment of the invention, the striking device includes a single spiral, the excitation current for the device being supplied through the exterior end of the spiral and removed through the axle on which the suspension unit is stuck, or vice versa.

With the above and other objects in view that will hereinafter appear, the nature of the invention will be more clearly understood by reference to the following detailed description, the appended claims and the several views illustrated in the accompanying drawings: In the drawings FIG. 1 is an exploded perspective view of an embodiment of the striking device according to the invention.

Figure 1:
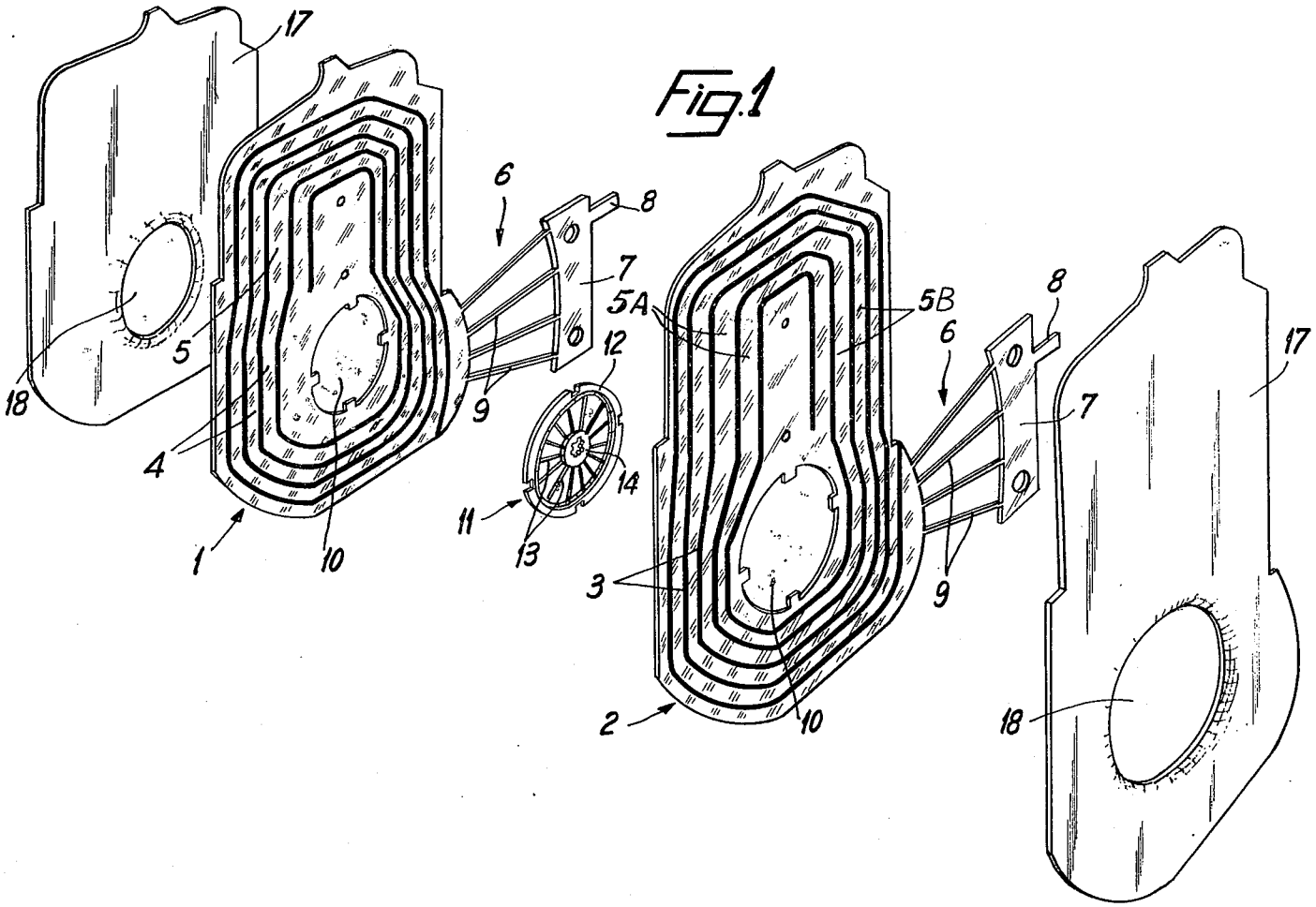
Figure 2:
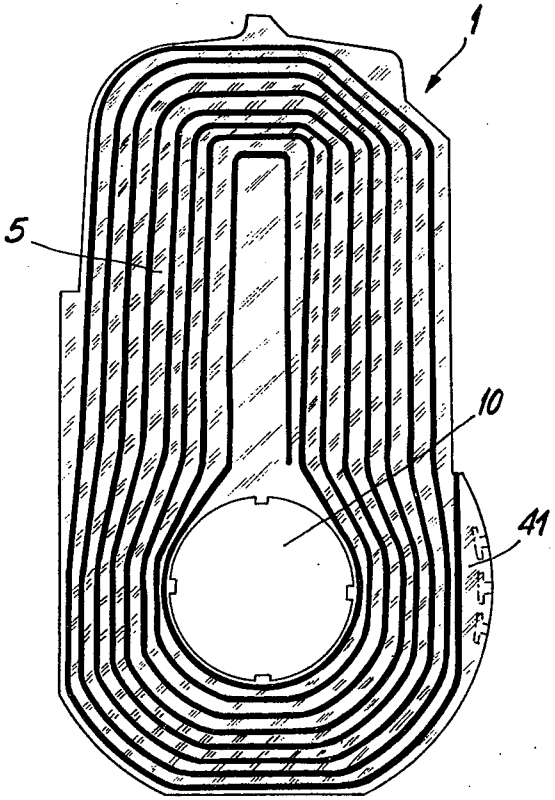

The striking device according to the invention as shown in FIG. 1 comprises two flat spirals 1 and 2, cut, by engraving methods well known in printed circuit technology, in thin sheets of copper. In this Figure (and in FIGS. 2 and 7), the continuous interval 3 between the spirals has been represented by a thick line in order to simplify the drawing. These spirals are formed by the flat conductors 4 that remain after cutting of the continuous line 3. This method makes it possible to make rectilinear the portions 5A, 5B of the conductors 4 that will be subjected to the action of magnetic fields perpendicular to the planes of spirals 1 and 2. Moreover, it makes it possible to obtain conductors 4 that are wide and thus of low electrical resistance.

The exterior end of each spiral is integral with a connection unit 6 which is in a single piece with the corresponding spiral and comprises a connection zone 7 with a lug 8. The connection unit 6 further includes narrow strips 9 converging toward the center of a circular opening 10 provided in each spiral in its interior. Obviously, in this instance, the connection units 6 are cut in the same plates of copper and in the same manner as the corresponding spirals 1 and 2.

In the openings 10 of the spirals 1 and 2, placed opposite one another, there can be introduced and attached a suspension unit 11 exhibiting at least approximately the shape of a wheel 12 with spokes 13.

Figure 3:
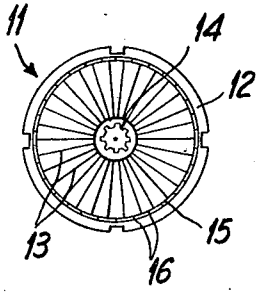
Figure 9:
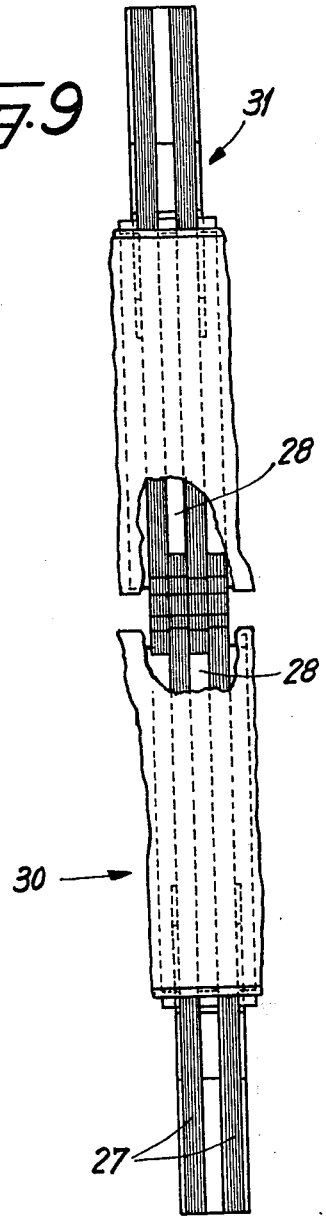
FIGS. 9 and 10 are fragmentary elevational views taken generally in accordance with the arrows IX and X, respectively, of FIG. 7.
Figure 10:
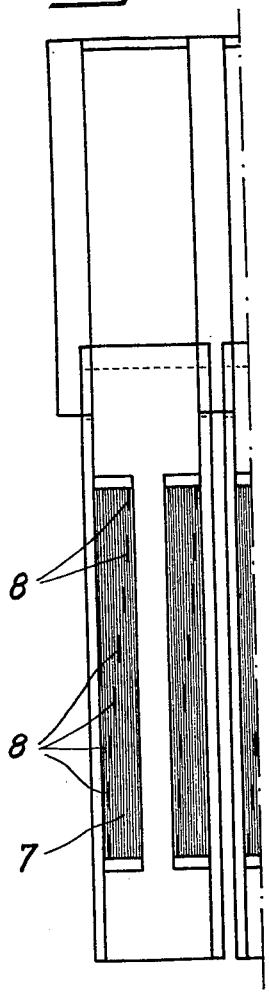

At the center of the wheel, the spokes 13 are joined by a hub 14 capable of being stuck onto an electrically insulating shaft 21 (FIG. 7), while at their other end (see also FIGS. 3 and 7) they are joined to the wheel 12 through the intermediary of a thin ring 15, concentric with said wheel and itself connected to the latter by short radial arms 16 displaced angularly with respect to the spokes 13. The suspension unit 11 is likewise obtained by chemical cutting in a metal foil made, for example, of beryllium bronze.

The directions of spirals 1 and 2 are such that, laid one against the other and assembled through the intermediary of a layer of insulating glue for example, their electromagnetic effects can be added, an electrical connection enabling them to be connected in series so that the excitation current is supplied through the connection unit 6 of one of the spirals and removed through the corresponding unit of the other. The suspension unit 11 is assembled, by soldering or gluing, to the spirals 1 and 2; then the latter are assembled to nonmagnetic lateral sides 17 made of "ARC 2140", by "METAL-IMPHY" for example, and having openings 18 that disengage the spokes 13 and the hub 14. The assembly of the sides 17 to the spirals 1 and 2 can likewise be effected by gluing with an insulating glue.

Thus, when such a device is stuck onto the fixed shaft 21 (see FIG. 7) traversing the hub 14, while the connection zones 7 are rendered fixed and magnetic means, e.g. magnets, subject the rectilinear parts 5A, 5B of the conductors 4 to adequate magnetic fields of opposite directions perpendicular to the planes of the spirals, it suffices to supply the latter with current through their connection units 6 in order that the striking device pivots about the fixed shaft, by elastic deformation of the spokes 12, the portions of the rings 15 disposed between the spokes 12 and the narrow strips 9. Consequently, by making this device integral with a striking hammer 19 (see FIG. 7) capable of interacting with an anvil 20 and by choosing appropriately the directions of the excitation current and of the magnetic field, the desired strike is obtained.

In FIGS. 2 to 6 there is illustrated a variant embodiment comprising only a single spiral 1, the excitation current arriving through the connection unit 6 and departing through the fixed axle 21 which is then a conductor, or vice versa. In this variant, the connection unit 6 is no longer an integral part of the spiral, but is designed to be attached to an end zone 41 of the latter.

Figure 4:
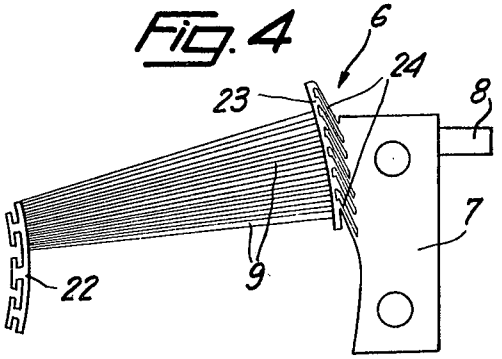
FIGS. 2, 3, 4 and 5 are elevational views of various elements of the striking device and show more particularly the details thereof.
Figure 5:
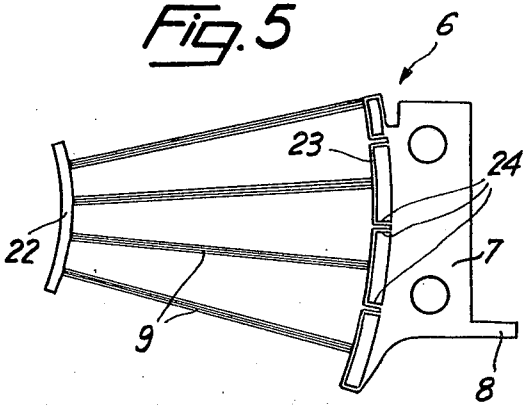

In FIGS. 4 and 5 there are shown embodiments of such a connection unit. They comprise a plurality of narrow strips 9 converging toward the hub 14 and integral, on the side of the zone 41, with a junction zone 22. In FIG. 4, the narrow strips are all grouped, while in FIG. 5 they are arranged in small spaced groups. Preferably, when a striking assembly comprises a pile of such devices, the narrow strips 9 of one are arranged so that they are situated between the narrow strips 9 of their neighbors. The junction zone 22 and the zone 41 can be designed so as simply to be able to be placed against each other in the form of FIG. 5 or fitted into each other in the form of FIG. 4.

In the connection unit of FIG. 4, the narrow strips 9 are joined to the connection zone 7 through the intermediary of a thin ring 23 concentric with the wheel 12 and itself connected to the zone 7 by narrow elastic strips 24, almost tangential, and subjected to a tractive force when the device pivots to make a strike.

In the connection unit of FIG. 5, the narrow strips 9 are joined to the connection zone 7 likewise through the intermediary of a thin ring 23. However, in this instance the latter is connected to the connection zone 7 by short radial arms 24 similar to the arms 16.

Figure 6:
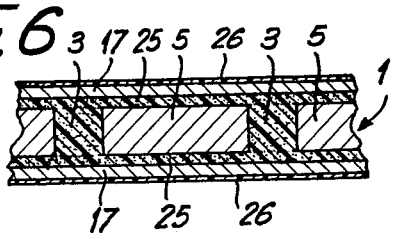
FIG. 6 is an enlarged fragmentary sectional view through the assembled elements of FIG. 1.

In FIG. 6 there is shown in partial section a device according to the invention comprising a single spiral 1. The latter is interposed between two side-plates 17 and assembled to them through the intermediary of layers of insulating glue 25, the glue filling up the spaces 3 between the portions 5 of the spiral. Externally, the side-plates 17 are coated with layers 26 of self-lubricating material.

In FIGS. 7 to 10 there is illustrated a dot striking system built with striking devices according to the invention made integral with hammers 19. This system comprises a set 30 of several groups 27 of several devices each, e.g. eight, these groups being mounted on the common axle 21 and separated by magnets and 28A, 28B and 28C, 28D that produce fields of opposite directions perpendicular to the spirals 1 (or 2) at the level of the rectilinear parts 5A, 5B of said spirals.

Figure 8:
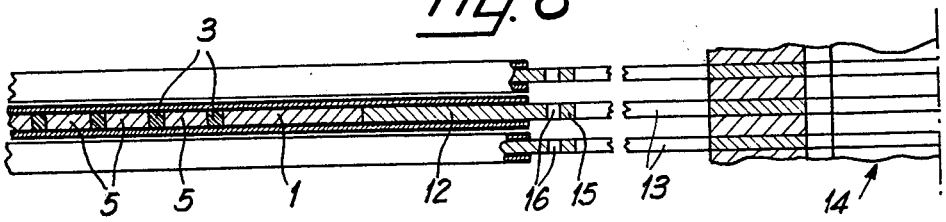
FIG. 8 is an enlarged sectional view taken generally along the line VIII—VIII of FIG. 7.

In FIG. 8 there is shown three striking devices according to the invention arranged side by side in a group 27. In order to increase the striking capacity of the system, the system includes a second set 31 (FIG. 9), identical to the set 30, whose groups 27 are arranged head-to-toe with those of the latter set, the groups 27 of one of the sets being introduced partially into the spaces requiring the magnets 28 of the other. The devices of the set 31 swing about a common axle 32 (FIG. 7).

Figure 7:
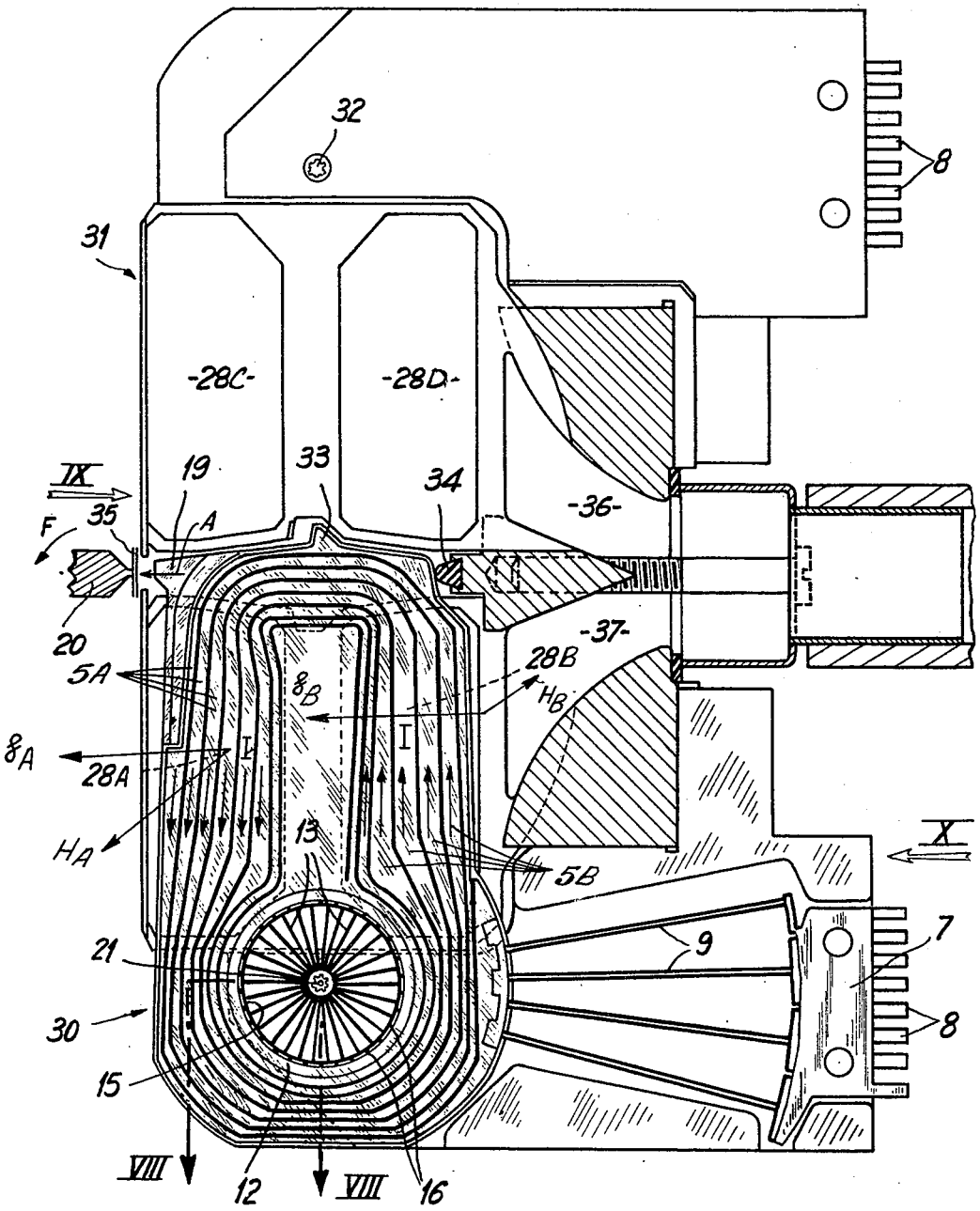
FIG. 7 is a side view of a striking system formed of a plurality of devices according to the invention.

As is shown in FIG. 7, on the devices there can be provided stops 33 designed to limit their excursion, while an adjustable stop 34 makes it possible to adjust the initial position of said devices.

When a device is chosen and supplied adequately electrically by its fixed connection zone 7, it swings about the axle 21 (or 32) in opposition to the elastic deformations of the spokes 13, rings 15 and 23, narrow strips 9, arms 24, etc. and it effects the striking of a dot on a printing support 35 by interaction of its hammer 19 with the anvil 20.

By successively selecting the various adequate striking devices, for example by means of electronic devices, the striking by dots of any design character or symbol can be effected by said system according to the invention.

Ventilation pipes 36 and 37, as shown in FIG. 7, can be provided to cool the striking devices.

With reference to FIG. 7, it will be seen that the permanent magnets 28A and 28B which lie adjacent to the coils of the lower set of coils will provide magnetic fields $H_A$ and $H_B$ of opposite directions. When the current delivered by the current generator flows through the coil, it will be apparent that the direct current flowing in part 5A is of oppposite direction to the direct current flowing in part 5B and that the two electromagnetic forces $f_A$ and $f_B$ exerted respectively on the parts 5A and 5B in the same direction and in the plane of the coil perpendicular to the anvil 20, i.e., directed towards the left in FIG. 7 as indicated by the arrow A. Since $f_A = f_B$, then the strike unit is subjected to a resulting magnetic force equal to $2f_A$ so that it swings about the fixed axle 21 towards the anvil 20.

Although several preferred embodiments of the invention have been specifically illustrated and described herein, it is to be understood that other variations of the striking device may be made without departing from the spirit and scope of the invention as defined by the appended claims.

I claim:

1. Striking device for a dot printer, said striking device comprising an electrodynamic coil operatively associated with a striking hammer and connected to a current generator, a deformable elastic suspension unit carried by said coil and having means for mounting on a fixed support, for substantially rotational movement about a first axis perpendicular to the plane of said coil, said coil being generally a spiral and being in the form of a thin foil sheet having at least one generally spiral cut therein dividing said sheet into two parallel rectilinear parts, first and second magnetic means providing first and second magnetic fields, the first rectilinear part being subjected to the action of the first magnetic field the direction of which is substantially perpendicular to the plane of the coil and to said first rectilinear part, the second rectilinear part being subjected to the action of the second magnetic field the direction of which is opposed to the direction of the first magnetic field.

2. A striking device according to claim 1 wherein said elastic suspension unit includes narrow strips which are coplanar with each other and with the plane of the coil.

3. Striking device according to claim 2, wherein said coil and said suspension unit are formed of thin foils whose thickness is several hundredths of a millimeter, and are formed by chemical engraving.

4. Striking device according to claim 2, wherein said coil and said suspension unit are separately formed and joined to each other.

5. Striking device according to claim 2, wherein said suspension unit has the form of a spoked wheel whose central hub has means for fixing the same on a fixed axle integral with said support, said wheel being inside said spiral.

6. Striking device according to claim 5, wherein spokes of said spoked wheel are integral with a thin ring which is concentric with said wheel and is connected to said wheel by short radial arms displaced angularly with respect to said spokes.

7. Striking device according to claim 1, wherein each spiral has an electrical energy connection unit formed by a plurality of coplanar narrow metal strips generally converging toward the center of said suspension unit, these narrow strips being rigid on one side with an edge of said spiral and on the other side with a fixed connection zone having means for connection to a generator for supplying current to said spiral.

8. Striking device according to claim 7, wherein said connection unit is formed by chemical engraving of a thin metal foil and is joined to the corresponding spiral.

9. Striking device according to claim 7, wherein at least on the side of said connection zone said narrow strips are connected to the connection zone by portions of a thin ring arranged concentric with the axle of the suspension unit and connected to said connection zone by short arms.

10. Striking device according to claim 9, wherein said arms are generally tangential with respect to said ring so as to be subjected to a traction when said spiral pivots to make a strike.

11. Striking device according to claim 7, wherein at one side of said spiral said narrow strips are integral with a zone for joining to said spiral.

12. Striking device according to claim 7, wherein said narrow strips on the side of the fixed connection zone are bent and comprise a short oblique part subjected to a traction when said spiral pivots to make a strike.

13. Striking device according to claim 1, wherein said striking device includes a single spiral, and there are means for supplying an excitation current from said current generator for said striking device through the exterior end of said spiral and through an axle on which said suspension unit is mounted.

14. Striking system comprising at least one set formed of groups of several striking devices, each striking device comprising an electrodynamic coil lying generally in a plane and operatively associated with a striking hammer, said coil including two parallel rectilinear parts, magnetic means producing a first magnetic field acting on said first rectilinear part and practically perpendicular to the plane of said coil and said first rectilinear part, second magnetic means producing a second magnetic field acting on said second rectilinear part with the direction of said second magnetic field being opposite to the direction of said first magnetic field, a deformable elastic suspension unit connecting said coil to a fixed support, said electrodynamic coil being a spiral in the form of a thin metal foil having at least one spiral cut therein, and said elastic suspension unit including narrow strips which are substantially coplanar with each other and with said spiral, said striking devices being juxtaposed side by side in a group with said groups being mounted onto a common axle and separated by the magnetic means which produce said magnetic fields, and means for separately introducing electrical energy into each of said coils.

15. Striking system according to claim 14, characterized in that said striking system includes two of said sets mounted in heat-to-toe relation, the groups of one of said sets fitting at least partially between the groups of the other of said sets.

16. A striking unit comprising a fixed axle, an elastic suspension unit fixedly mounted on said axle, an electrodynamic coil mounted on said suspension unit for pivoting relative to said fixed axis, said coil being in the form of a thin metal foil sheet having at least one spiral cut therein and defining at least one spiral strip including two parallel rectilinear parts, a striker hammer carried by said coil for movement therewith, first magnetic means disposed adjacent said coil remote from said axle for producing a first magnetic field substantially perpendicular to the plane of said foil sheet and to said first rectilinear part, second magnetic means producing a second magnetic field acting on said second rectilinear part with the direction of said second magnetic field being opposite to the direction of said first magnetic field, and means connected to said coil for selectively electrically connecting said coil to a source of electrical energy to effect a pivoting of said coil and said hammer about said axis.

17. Striking unit according to claim 16 wherein said first and second magnetic means are offset relative to said axle and said coil is elongated generally towards said magnetic means relative to said axle, portions of said spiral strip remote from said magnetic means being generally concentric relative to said axle, portions of said spiral strip generally aligned with said magnetic means being elongated in a direction generally away from and towards said axle.

* * * * *